US006130659A

United States Patent [19]

Kim et al.

[11] Patent Number: 6,130,659

[45] Date of Patent: Oct. 10, 2000

[54] SIGNAL MANAGEMENT APPARATUS FOR USE IN DISPLAY MONITOR OF A MULTIMEDIA COMPUTER SYSTEM AND METHOD USING ON SCREEN DISPLAY

[75] Inventors: Sung-Je Kim, Kyungki-do; Kook-Won Kim, Seoul, both of Rep. of Korea

[73] Assignee: SamSung Electronics Co., Ltd., Suwon, Rep. of Korea

[21] Appl. No.: 09/075,938

[22] Filed: May 12, 1998

[30] Foreign Application Priority Data

May 16, 1997 [KR] Rep. of Korea ..... 97-18834
Jul. 3, 1997 [KR] Rep. of Korea ..... 97-30741

[51] Int. Cl.[7] ..... G09G 5/00

[52] U.S. Cl. ..... 345/112; 345/347; 345/352

[58] Field of Search ..... 345/327, 5, 112, 345/347, 1–3, 339, 352, 353, 354

[56] References Cited

U.S. PATENT DOCUMENTS 5,815,080 9/1998 Taguchi ..... 340/635
5,949,491 9/1999 Callahan et al. ..... 345/327

*Primary Examiner*—Vijay Shankar
*Assistant Examiner*—Mansour M. Said
*Attorney, Agent, or Firm*—Robert E. Bushnell, Esq.

[57] ABSTRACT

A signal management apparatus for use in a display monitor having an on screen display (OSD), comprises a control button unit comprising at least a signal management switch for generating an information management control signal; a microcomputer for sensing information signals applied thereto from different external sources and producing on-screen display data indicating of the external sources of applied signals sensed in response to the information management control signal generated from the control button unit when the signal management switch is selected; and an on-screen display circuit for processing the on-screen display data from the microcomputer and producing corresponding on-screen display signals for a visual display on the monitor to inform a user of the applied signals.

10 Claims, 4 Drawing Sheets

SIGNAL MANAGEMENT APPARATUS FOR USE IN DISPLAY MONITOR OF A MULTIMEDIA COMPUTER SYSTEM AND METHOD USING ON SCREEN DISPLAY

CLAIM FOR PRIORITY

This application makes reference to, incorporates the same herein, and claims all benefits accruing under 35 U.S.C. §119 from an application for SIGNAL MANAGEMENT APPARATUS AND METHOD USING ON SCREEN DISPLAY earlier filed in the Korean Industrial Property Office on May 16, 1997, and Jul. 3, 1997, and there duly assigned Serial Nos. 18834/1997 and 30741/1997 respectively, copies of which applications are annexed hereto.

BACKGROUND OF THE INVENTION

1. Technical Field

The present invention relates to a multimedia computer system, and more particularly, relates to a signal management apparatus for use in a display monitor of a multimedia computer system with an on-screen display (OSD) and process of providing a visual display of an input signal on the display monitor using an OSD function for the convenience of users.

2. Related Art

Multimedia computer systems for processing a wide variety of information data, such as text, sounds, graphics, animation, movie, and so forth have become increasingly popular for home and commercial applications. In order to perform multimedia function, high performance video card, sound card, TV/radio card, modems, etc. must be installed in the computer system. In addition, media players such as CD-ROM drives as well as corresponding software drivers must also be implemented. Information data ofthe multimedia computer system must be transmitted to peripheral devices such as display monitors at higher transmission speed. As a result, display monitors must contain sophisticated hardware to accommodate such a data transmission speed as well as multiple information signals from multimedia sources.

Recently, wide display monitors have been adopted to accommodate multimedia applications for processing a variety of information signals generated from multimedia sources such as computer, VTR, and TV. A typical wide display monitor has a width to height ratio of 16:9 as opposed to 4:3 of conventional display monitors, and is equipped with a D-SUB, a headphone, a number of jacks for receiving a composite video signal and a sound signal from TV. However, I have observed that such a wide display monitor has several drawbacks. The user cannot identify information signals applied to the display monitor from different multimedia sources and select a particular information signal when a variety of information signals are input to the display monitor.

SUMMARY OF THE INVENTION

Accordingly, it is therefore an object ofthe present invention to provide a signal management apparatus for use in a display monitor of a multimedia computer system.

It is also an object to provide a signal management apparatus for use in a display monitor and process of using an on-screen display (OSD) for a multimedia computer system.

It is further an object to provide a signal management display monitor and process of using an on-screen display (OSD) for a user to identify and select a particular information signal when a wide variety of information signals from different multimedia sources are applied to the display monitor.

These and other objects of the present invention can be achieved by a display monitor or a signal management apparatus for use in a display monitor of a multimedia computer system having an on screen display (OSD). The display monitor or signal management apparatus comprises a control button unit having at least a signal management switch for generating an information management control signal; a microcomputer for sensing information signals applied thereto from different external sources and producing on-screen display data indicating which of the external sources of applied signals is sensed in response to the information management control signal generated from the control button unit when the signal management switch is selected; and an on-screen display circuit for processing the on-screen display data from the microcomputer and producing corresponding on-screen display signals for a visual display to inform a user of the applied signals.

In accordance with another aspect of the present invention, a signal management method of a display monitor of a multimedia computer system using an on screen display (OSD) includes determining whether a signal management switch for signal management using the OSD is selected, checking if there is any signal applied to the display monitor; if any applied signal is detected, checking all the applied signals; transmitting OSD data of the input signals sensed; and processing the OSD data using the OSD circuit and providing a visual display of the OSD data to inform a user of the applied signals.

The present invention is more specifically described in the following paragraphs by reference to the drawings attached only by way of example.

BRIEF DESCRIPTION OF THE DRAWINGS

A more complete appreciation of the present invention, and many ofthe attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
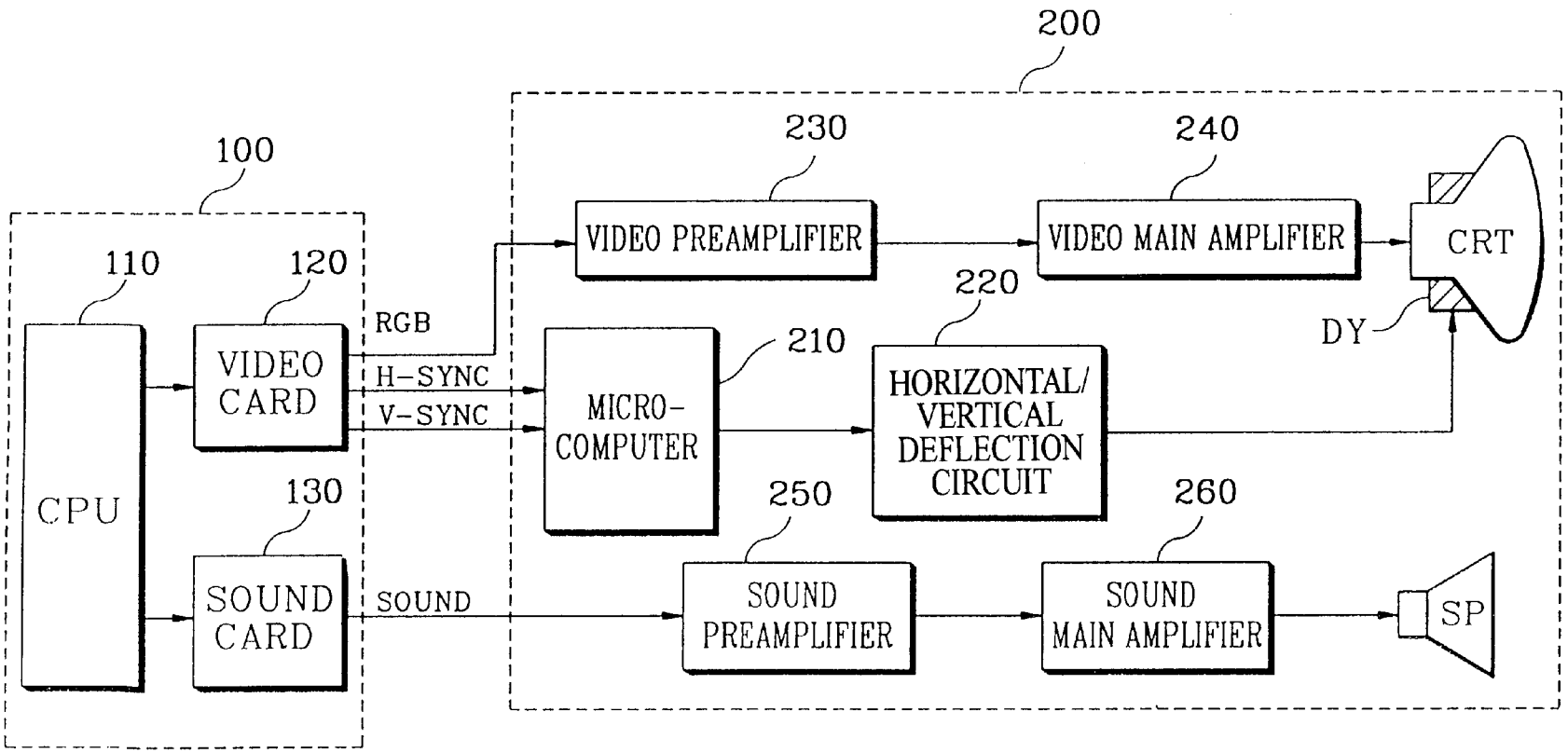
FIG. 1 is a block diagram of an exemplary display monitor of a computer system.

Referring now to the drawings and particularly to FIG. 1, which illustrates a typical multimedia computer system with a computer main body 100 and a display monitor 200. As shown in FIG. 1, the computer main body 100 includes a central processing unit (CPU) 110 for performing programs having video and sound data and generating video and sound control signals and data resulting from the performance of the program; a video card 120 for receiving the data and video control signal from the CPU 110 and generating a composite video signal (R, G, B) and horizontal and vertical synchronization signals H-SYNC and V-SYNC for synchronizing the video signal (R, G, B); and a sound card 130 for receiving the sound control signal from the CPU 110 and processing the sound data to produce a sound signal.

The display monitor 200, which receives the video signal (R, G, B) and the sound signal from the video card 120 and the sound card 130 of the computer main body 100 for output via a cathode-ray tube (CRT) and a speaker (SP) respectively, includes a microcomputer 210, a horizontal/vertical deflection circuit 220, a video preamplifier 230, a video main amplifier 240, a CRT, a sound preamplifier 250, a sound main amplifier 260 and a speaker (SP). The microcomputer 210 first identifies a video signal (R, G, B) mode and generates a reference oscillation signal in response to the horizontal and vertical sync signals, H-SYNC and V-SYNC, from the video card 120 of the computer main body 100. The horizontal and vertical deflection circuit 220 generates horizontal/vertical sawtooth current in a deflection yoke (DY) in response to the reference oscillation signal from the microcomputer 210.

The video preamplifier 230 raises the level of the video signal (R, G, B) received from the video card 120 to a predetermined level and applies the raised level of the video signal to the video main amplifier 240. The video main amplifier 240 sufficiently amplifies the video signal received from the video preamplifier 230 before sending the same to the CRT. The CRT determines a scanning cycle based upon a cycle of the horizontal/vertical sawtooth current in the DY and displays an image in response to the video signals received from the video main amplifier 240.

The sound signal, SOUND, output from the sound card 130 of the computer main body 100 is amplified by a sound preamplifier 250, thus having a predetermined level, before being sent to the sound main amplifier 260. The sound main amplifier 260 sufficiently amplifies the raised level of the sound signal, SOUND, received from the sound preamplifier 250, before supplying the same to the speaker (SP). The speaker outputs the sound signal, SOUND, received from the sound main amplifier 260 as an audible signal.

Figure 2A:
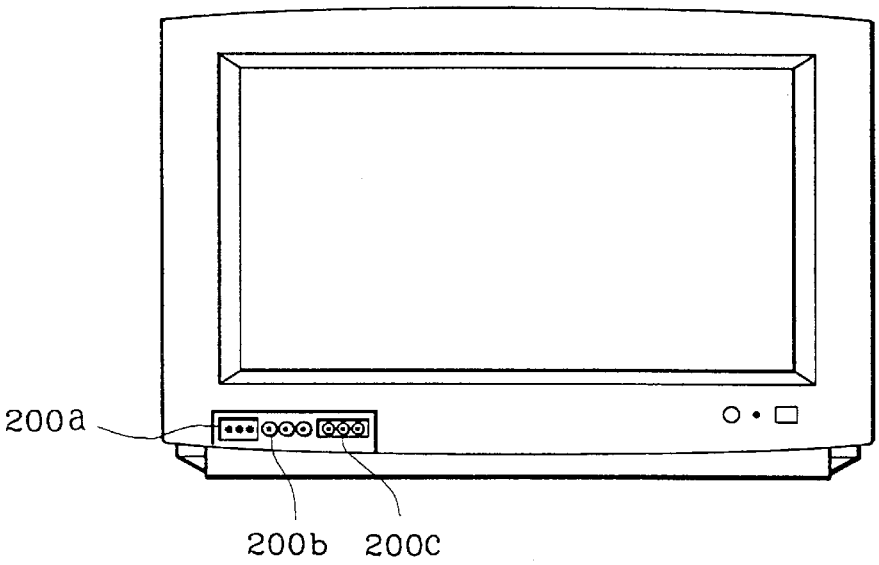
FIG. 2A is a front view of a wide display monitor of a multimedia computer system.
Figure 2B:
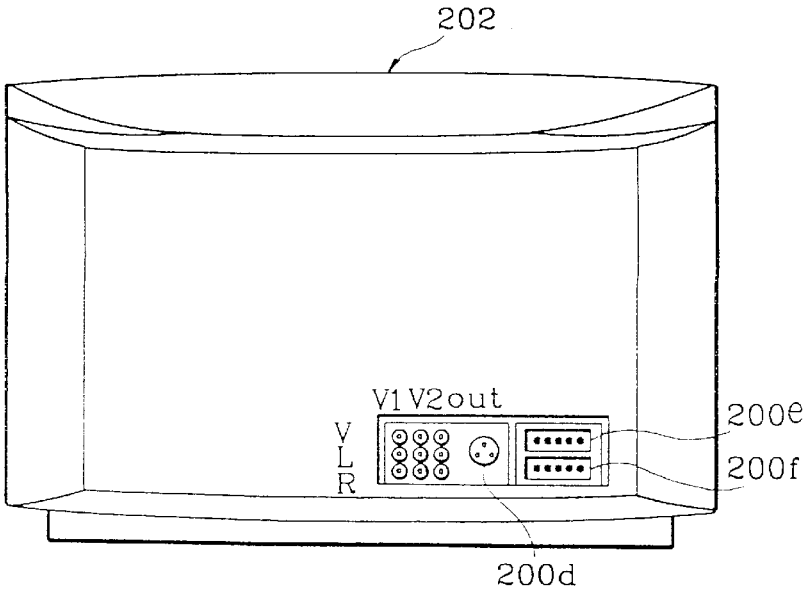
FIG. 2B is a rear view of a wide display monitor of a multimedia computer system.

FIGS. 2A and 2B illustrate a wide display monitor 202 which is typically used for multimedia computer systems and generally has a width to height ratio of 16:9 as opposed to a ratio of 4:3 of a conventional display monitor. In order to process a wide variety of information signals generated from the computer, VTR, and TV, such a wide display monitor is equipped with a D-SUB 200*a,* a headphone, a jack 200*b,* and an RCA jack 200*c* for receiving composite video signals in a front case. In addition, the wide display monitor is equipped with a number of jacks for receiving a composite video signal and a sound signal from TV; a jack 200*d* for receiving an SVHS composite signal; a terminal 200*e* for passing through signals; and a D-SUB 200*f* in its rear case. As I have observed however, this type of wide display monitor has several drawbacks in that the user cannot identify signals presently applied to the display monitor from the outside and select a particular information signal when a wide variety of information signals are applied to the display monitor.

Figure 3:
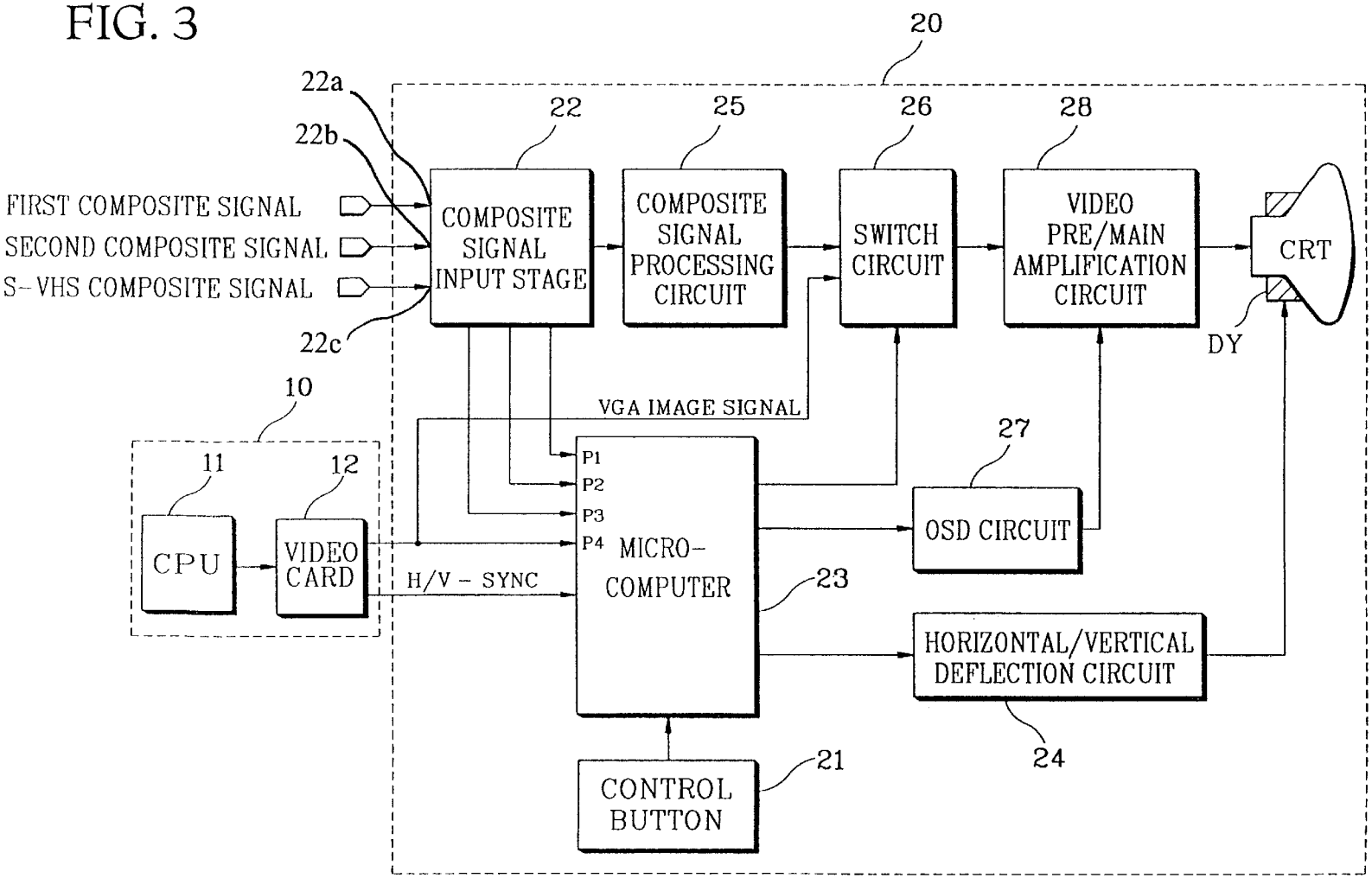
FIG. 3 is a block diagram of a display monitor of a multimedia computer system according to the principles of the present invention.

Turning now to FIG. 3 which is a block diagram of a display monitor for use in a multimedia computer system constructed according to the principles of the present invention. A personal computer (PC) 10 includes a CPU 11 for performing software selected by a user and generates corresponding data, and a video card 12 for generating a video graphics array (VGA) video signal by processing the data from the CPU 11 and producing horizontal/vertical sync signals, H/V-SYNC, for synchronizing the VGA video signal. A display monitor 20 processes the VGA video signal received from the PC 10, and first and second composite signals and SVHS composite signals applied from the outside.

The display monitor 20 includes a control button unit 21, a composite signal input stage 22, a microcomputer 23, a horizontal/vertical deflection circuit 24, a composite signal processing circuit 25, a switch circuit 26, an on-screen display (OSD) circuit 27, a video pre/main amplification circuit 28 and a cathode-ray tube (CRT). The control button unit 21 comprises a control switch for adjusting image and controlling display monitor functions and a selection switch for selection of signal management function. The control button unit 21 generates either a control switch signal or a signal management function selection switch signal. The composite signal input stage 22 has a plurality of input jacks 22*a,* 22*b,* and 22*c* for receiving a plurality of composite signals, and receives the first and second composite signals and SVHS composite signal from the outside. The microcomputer 23 senses the first and second composite signals and SVHS composite signal applied from the composite signal input stage 22 and the VGA video signal received from the video card 12 for generating horizontal and vertical oscillation signals by processing the horizontal and vertical sync signals, H-SYNC and V-SYNC, received from the video card 12. The composite signal processing circuit 25 selects one of the first and second composite signals and the SVHS composite signal received from the composite signal input stage 22 according to a selection signal received from the microcomputer 23 and separates a chrominance signal and a luminance signal with respect to the composite signals. The switch circuit 26 selects either the chrominance signal of the composite signal selectively applied from the composite signal processing circuit 25 or the VGA video signal transmitted from the video card 12 and outputs a selected video signal. The OSD circuit 27 processes OSD data which the microcomputer 23 outputs according to a selection of the signal management switch from the control button unit 21 and outputs a corresponding OSD signal. The video pre/main amplification circuit 28 amplifies the OSD signal from the OSD circuit 27 and the video signal selectively output from the switch circuit 26 and supplies the amplified signals to the CRT.

The microcomputer 23 has ports P1 to P4 for sensing the signals applied from the composite signal input stage 22 and the signals from the video card 12 of the PC 10. The number of ports should be compatible with the number of information signals applied to the display monitor.

Figure 4:
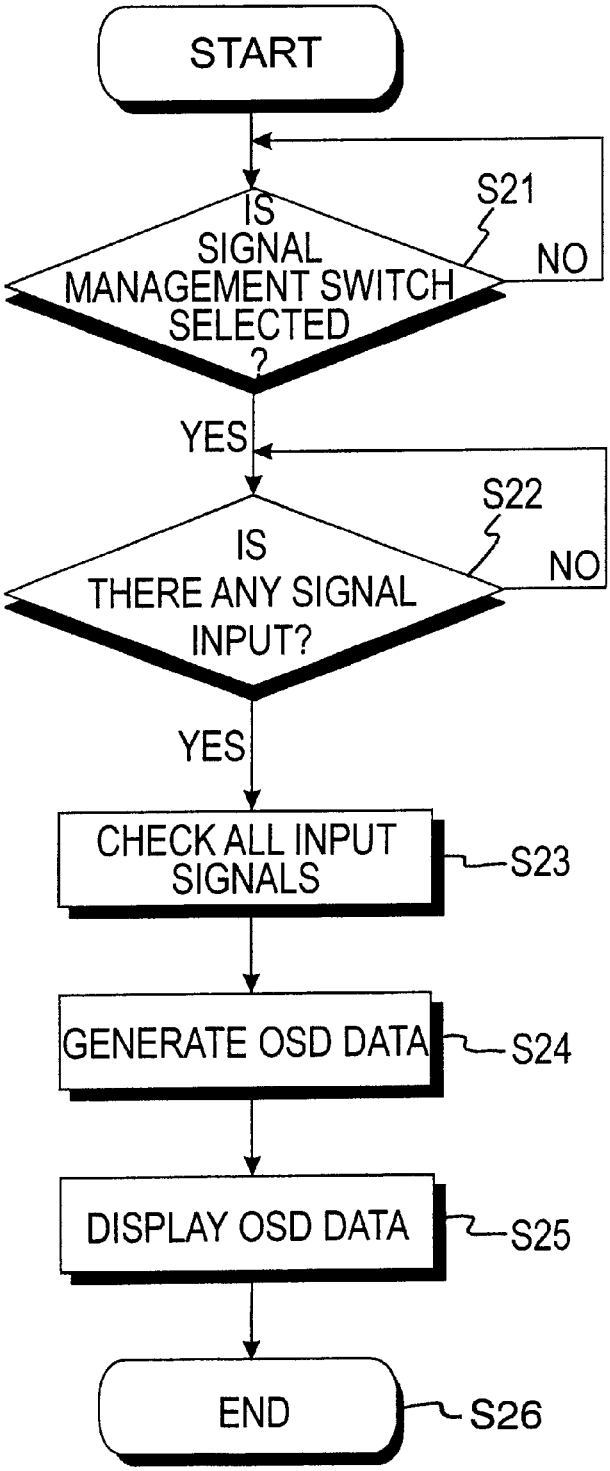
FIG. 4 is a flow chart of a signal management method using an OSD according to the principles of the present invention.

Now, the process of managing a wide variety of information signals using the OSD stored in the microcomputer 23 will now be described in detail with reference to FIG. 4.

The signal management method includes determining whether a signal management switch is selected at step S21, checking if any signal is input to the display monitor at step S22, if there is an input signal, checking all the input signals at step S23, transmitting OSD data corresponding to the input signals at step S24, displaying the OSD data through CRT after processing the OSD data using the OSD circuit 27 at step S25, and allowing a user to select or check the sensed signals based upon the OSD data displayed in the CRT and then terminating the signal management at step S26.

Specifically, the VGA video signal output from the video card 12 of the computer 10 is applied to the switch circuit 26.

The first and second composite signals applied from the external equipments, such as TV and VTR, and the SVHS composite signal are transmitted to the composite signal processing circuit 25 via the composite signal input stage 22. The composite signals are processed by the composite signal processing circuit 25 and then applied to the switch circuit 26.

The composite signal processing circuit 25, which includes a digital computer filter and a chroma circuit (not shown), separates the chrominance signal and luminance signal with respect to the first and second composite signals and the SVHS composite signal.

The first and second composite signals and SVHS composite signal where the chrominance signal and the luminance signal are separated and the VGA video signal are applied to the switch circuit 26 and one of them is selected according to the selection signal output from the microcomputer 23. The signal selected by the switch circuit 26 is applied to the video pre/main amplification circuit 28. The video pre/main amplification circuit 28 which receives the VGA video signal or the chrominance signal of the selected composite signal sufficiently amplifies the received signal and sends the same to the CRT or display for a visual display.

If the VGA video signal is selected, it is displayed on the CRT in synchronization with the cycle of the sawtooth current generated in the DY by the horizontal/vertical deflection circuit 24. At this time, the horizontal/vertical deflection circuit 24 generates the sawtooth current by processing the horizontal/vertical sync signals, H/V-SYNC, output from the video card 12 of the computer 10 according to the horizontal/vertical oscillation signals generated by the microcomputer 23.

Alternatively, if one of the composite signals output from the composite signal processing circuit 25 is selected, it is displayed in synchronization with a sawtooth current generated by the horizontal/vertical deflection circuit 24 in the DY according to the luminance signal separated by the composite signal processing circuit 25.

While the display monitor 20 is performing such general operation, the user can identify a signal presently applied to the display monitor 20 by selecting the switch for selection of the signal management using the OSD at step S21. Once the signal management switch is selected, the signal of the switch is applied to the microcomputer 23. Whether or not there is any signal input to the microcomputer 23 is determined through the signal sensing ports P1 to P4 at step S22.

If there is no signal input to the microcomputer 23, the system stands by until some signal is input to the signal sensing ports P1 to P4. Once any signal is detected at step S22, the signal sensing ports P1 to P4 of the microcomputer 23 are checked at step S23. If signals are sensed through the signal sensing ports P1 to P4 in the microcomputer 23, the OSD data is transmitted at step S24.

Specifically, the microcomputer 23 processes the signals sensed through the signal sensing ports P1 to P4 so as to generate OSD data. This OSD data is applied to the OSD circuit 27. The OSD circuit 27 generates the OSD signal in response to the OSD data and applies the OSD signal to the video pre/main amplification circuit 28. The video pre/main amplification circuit 28 sufficiently amplifies the OSD signal and sends a result of the amplification to the CRT. Finally, the OSD data is displayed in the CRT.

The user identifies a signal source presently connected to the display monitor 20 based upon the OSD displayed on the screen of the monitor and then the signal management using the OSD terminates at step S26. Since the user can identify the state of signal connection to the display monitor 20 using the OSD function, the user is free from making a mistake of selecting a signal which is not connected to the display monitor 20.

As described above, the signal management display monitor of the present invention permits the user to identify the state of signal connection thereto using an OSD function, thereby realizing efficient signal management.

While there have been illustrated and described what are considered to be preferred embodiments of the present invention, it will be understood by those skilled in the art that various changes and modifications may be made, and equivalents may be substituted for elements thereof without departing from the true scope ofthe present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A display monitor having an on-screen display, comprising:

a control button unit comprising at least a signal management switch for generating an information management control signal to selectively display on said on-screen display of said display monitor a visual display corresponding to any information signal being applied to said display monitor from any of corresponding different external sources;

a microcomputer for sensing a video signal being applied to said display monitor from a personal computer while sensing any information signal being applied to said display monitor from any of corresponding said different external sources and selectively producing on-screen display data indicating which of said different external sources of any corresponding information signal being applied to said display monitor is sensed by said microcomputer in response to said information management control signal generated from said control button unit when said signal management switch is selected and, alternatively, said microcomputer selectively producing on-screen display data corresponding to said video signal from said personal computer; and an on-screen display circuit for processing said on-screen display data from said microcomputer indicating any of said different external sources of any corresponding information signal being applied to said display monitor and producing corresponding on-screen display signals for a visual display on said on-screen display of said display monitor to inform a user of any information signal being applied to said monitor from any of said different external sources and, alternatively, for processing said on-screen display data corresponding to said video signal for a visual display corresponding to said video signal from said personal computer on said on-screen display of said display monitor.

2. The display monitor of claim 1, further comprised of said microcomputer having a plurality of input ports each for sensing a corresponding information signal externally applied to said display monitor.

3. The display monitor of claim 1, further comprised of said different external sources comprising any one of a video tape recorder and a television.

4. The display monitor of claim 1, further comprising a composite signal input stage including a plurality of input jacks each for receiving a corresponding information signal from a corresponding one of said different external sources, said composite signal input stage being connected to said microcomputer to provide a corresponding information signal to a corresponding one of a plurality of input ports of said microcomputer.

5. A signal management method in a display monitor having an on-screen display, comprising the steps of:

determining whether a signal management switch for signal management using said on-screen display has been selected to selectively display on said on-screen display of said display monitor a visual display corresponding to any information signal being input to said display monitor from a corresponding external source;

when said signal management switch has been selected, checking whether there is any information signal being input to said display monitor from a corresponding external source via a signal input terminal;

when there is any information signal being input to said display monitor, sensing any information signal being input via said signal input terminal by a microcomputer of said display monitor, and generating selectively by said microcomputer on-screen display data indicating a corresponding external source of any information signal being input via said signal input terminal and, alternatively, generating selectively by said microcomputer on-screen display data corresponding to a video signal being input to said display monitor from a personal computer sensed by said microcomputer;

providing a visual display corresponding to said on-screen display data generated by said microcomputer indicating a corresponding external source of any information signal being input to said display monitor on said on-screen display of said display monitor to inform a user of any information signal being input via said signal input terminal, when said microcomputer generates said on-screen display data indicating a corresponding external source of any information signal being input to said display monitor; and providing a visual display corresponding to said on-screen display data generated by said microcomputer on said on-screen display of said display monitor corresponding to said video signal from said personal computer, when said microcomputer generates said on-screen display data corresponding to said video signal from said personal computer.

6. The method of claim 5, further comprised of a corresponding external source comprising any one of a video tape recorder and a television.

7. The method of claim 5, further comprised of said signal input terminal having a plurality of input jacks for receiving a plurality of different information signals from corresponding different external sources.

8. A monitor having an on-screen display, comprising:

a signal input terminal for receiving information signals from corresponding different external sources to be displayed on said on-screen display of said monitor;

an operational panel comprising at least a signal management switch, said signal management switch to selectively display on said on-screen display of said monitor a visual display corresponding to any information signal being input to said monitor from any of corresponding said different external sources;

a controller for sensing any information signal being input via said signal input terminal from any of corresponding said different external sources and selectively producing on-screen display data indicating which of said different external sources of any corresponding information signal being input to said monitor is sensed when said signal management switch is selected and, alternatively, said controller for sensing a video signal being input to said monitor from a personal computer and selectively producing on-screen display data corresponding to said video signal from said personal computer; and an on-screen display unit for receiving from said controller and processing said on-screen display data corresponding to any information signal being input from any of corresponding said different external sources and providing a corresponding visual display on said on-screen display of said monitor and, alternatively, said on-screen display unit for receiving from said controller and processing said on-screen display data corresponding to said video signal from said personal computer and providing a corresponding visual display on said on-screen display of said monitor.

9. The monitor of claim 8, further comprised of said signal input terminal comprising a plurality of input jacks for receiving said information signals when input from corresponding said different external sources, said signal input terminal being connected to said controller to provide a corresponding information signal to a corresponding one of a plurality of input ports of said controller.

10. The monitor of claim 8, further comprised of said different external sources comprising any of a video tape recorder and a television.

* * * * *